US005674675A

United States Patent [19]

Inoue

[11] Patent Number: 5,674,675

[45] Date of Patent: Oct. 7, 1997

[54] SILVER HALIDE PHOTOGRAPHIC MATERIAL

[75] Inventor: Rikio Inoue, Kanagawa, Japan

[73] Assignee: Fuji Photo Film Co., Ltd., Kanagawa, Japan

[21] Appl. No.: 616,049

[22] Filed: Mar. 14, 1996

Related U.S. Application Data

[63] Continuation of Ser. No. 344,632, Nov. 17, 1994, abandoned, which is a continuation of Ser. No. 126,011, Sep. 23, 1993, abandoned, which is a continuation of Ser. No. 933,185, Aug. 21, 1992, abandoned.

[30] Foreign Application Priority Data

Aug. 23, 1991 [JP] Japan ..... 3-235702

[51] Int. Cl.[6] ..... G03C 1/005; G03C 1/035

[52] U.S. Cl. ..... 430/567; 430/608; 430/631; 430/642

[58] Field of Search ..... 430/567, 608, 430/631, 642

[56] References Cited

U.S. PATENT DOCUMENTS

| | | | |
|---|---|---|---|
| 3,359,108 | 12/1967 | Dubosc et al. | 430/631 |
| 3,637,391 | 1/1972 | Saleck et al. | 430/569 |
| 4,232,117 | 11/1980 | Naoi et al. | 430/539 |
| 4,439,520 | 3/1984 | Kofron et al. | 430/567 |
| 4,478,929 | 10/1984 | Jones et al. | 430/567 |
| 4,504,570 | 3/1985 | Evans et al. | 430/223 |
| 4,797,354 | 1/1989 | Saitou et al. | 430/567 |
| 4,914,012 | 4/1990 | Kawai | 430/631 |
| 5,208,139 | 5/1993 | Ishigaki | 430/607 |

FOREIGN PATENT DOCUMENTS

| | | | |
|---|---|---|---|
| 323215 | 7/1989 | European Pat. Off. | 430/569 |
| 60-95431 | 5/1985 | Japan | 430/631 |
| 1566362 | 3/1978 | United Kingdom . | |

*Primary Examiner*—Mark F. Huff

*Attorney, Agent, or Firm*—Sughrue, Mion, Zinn, Macpeak & Seas

[57] ABSTRACT

A silver halide photographic material comprising a support having thereon at least one silver halide emulsion layer coated on at least one side of the support. The at least one silver halide emulsion layer comprises a silver halide emulsion containing colloidal silica. 70% or more of the total projected area of all of the silver halide grains contained in the emulsion are tabular grains having an aspect ratio of 3 or more. The mean iodide content of all of the silver halide grains contained in the emulsion is 0.6 mol % or less. The photographic material provides pressure resistance, without lowering the photographic sensitivity of the chemically-sensitized tabular silver halide grains in the emulsion layer.

7 Claims, No Drawings

SILVER HALIDE PHOTOGRAPHIC MATERIAL

This is a continuation of application Ser. No. 08/344,632 filed Nov. 17, 1994, now abandoned, which is a continuation of application Ser. No. 08/126,011, filed Sep. 23, 1993, now abandoned, which is a continuation application of application Ser. No. 07/933,185, filed Aug. 21, 1992, now abandoned.

FIELD OF THE INVENTION

The present invention relates to a silver halide photographic material containing tabular silver halide grains, and more particularly to a silver halide photographic material having high sensitivity and improved pressure characteristics.

BACKGROUND OF THE INVENTION

In general, pressure in various forms is imparted to a silver halide emulsion-coated photographic material. For instance, an ordinary photographic negative film is folded when it is rolled into a patrone (cartridge) or charged into a camera, and is stretched or pushed and rubbed with the conveying part of a camera for forwarding the exposed films.

On the other hand, since a sheet-like film such as a printing photographic material or a medical direct X-ray photographic material is generally handled directly by hand, it is often folded and bent. In addition, the sheet-like film is brought into contact with a metal or rubber part with great force in a bright room-type conveying means or high speed changer.

A large pressure is applied to all photographic materials in cutting or machining the same.

Where pressure of various kinds is imparted to photographic materials, pressure is imparted to the silver halide grains via a binder of the silver halide grains or a high molecular weight substance as a medium. It is known that pressure as imparted to silver halide grains causes blackening not corresponding to the exposure amount and also causes desensitization, as described in detail, for example, in K. B. Mather, *J. Opt. Soc. Am.*, 38, 1054 (1948); P. Faelens and P. de Smet., *Sci. et Ind. Photo.*, 25, No. 5, 178 (1954); and P. Faelens, *J. Phot. Sci.*, 2, 105 (1954).

Therefore, there is a strong demand for photographic materials, the photographic properties of which do not vary with the application of pressure.

On the other hand, there is a demand for emulsions having a higher sensitivity. High-sensitivity photographic materials may be exposed for photographing objects with no flash even at night, or for photographing rapidly moving objects at a high shutter speed. For X-ray photographing with such high-sensitivity photographic materials, the X-ray dose required for exposure may be reduced to thereby minimize X-ray exposure to the human body.

However, in general, there is an unfavorable relationship between the photographic sensitivity of an emulsion and the pressure sensitivity thereof. Particularly, when the photographic sensitivity of an emulsion is increased, the pressure sensitivity thereof also rises.

In addition, sensitizing dyes promote fogging of silver halides and deteriorate a photographic characteristics upon application of pressure. In color sensitization of a photographic material, if a large quantity of a sensitizing dye is added thereto to increase light absorption and thereby elevate the color sensitivity, unfavorable black fogging of the resulting material is noticeably increased when pressure is applied thereto. Known means of improving pressure characteristics to overcome the above problems include incorporating a plasticizer such as a polymer or an emulsified substance into the emulsion, and using a silver halide emulsion having a decreased ratio of silver halide/gelatin such that the pressure applied to the emulsion is not directly imparted to the silver halide grains therein.

British Patent 738,618 discloses a method for improving pressure characteristics using heterocyclic compounds; British Patent 738,637 discloses a method using alkyl phthalates; British Patent 738,639 discloses a method using alkyl esters; U.S. Pat. No. 2,960,404 discloses a method using polyhydric alcohols; U.S. Pat. No. 3,121,060 discloses a method using carboxyalkyl celluloses; JP-A-49-5017 discloses a method using paraffin and carboxylates (the term "JP-A" as used herein means an "unexamined published Japanese patent application"); and JP-B-53-28086 discloses a method using alkyl acrylates and organic acids (the term "JP-B" as used herein means an "examined Japanese patent publication").

However, adding a plasticizer reduces the mechanical strength of emulsion layers, such that the addition amount thereof is limited. If the addition amount of gelatin is increased, development of the resulting material is retarded such that the sensitivity thereof is unacceptably lowered. In any event, such methods alone do not provide a sufficient effect.

In general, cubic or octahedral silver halide grains or spherical silver halide grains such as pebble like grains are less deformed upon application of external force due to their shape and have a lower pressure sensitivity, as compared to tabular grains having a large aspect ratio of projected area diameter/thickness. Therefore, even by using the above-described improving means which hardly provide a sufficient effect, the pressure characteristics of the former cubic, octahedral or spherical grains can be improved to a fairly satisfactory, although insufficient level.

On the other hand, since tabular grains have a large coating area per unit area of silver halide, as described in U.S. Pat. Nos. 4,434,226, 4,439,510 and 4,425,425, tabular grains may provide a high optical density even though a small amount of silver is coated.

In addition, since tabular grains have a large surface area per unit volume, tabular grains adsorb a larger quantity of sensitizing dyes in color sensitization as compared to other grain types to provide a high light-capturing yield in relation to the incident light. In order to efficiently utilize this characteristic, a sensitizing dye is preferably added in an amount of 60% or more, preferably 80% or more, more preferably 100% or more, of the saturation adsorption amount. However, as described above, an increase in the addition amount of the sensitizing dye results in increased pressure sensitivity of the resulting emulsion. In addition, due to the shape of the grains, tabular grains are readily deformed upon the application of external force. As a result, satisfactory conditions are not be attained by the above described method.

JP-A-64-72141 discloses addition of a polyhydroxybenzene to tabular grains to retard pressure blackening of the emulsions. In accordance with this method, however, addition of a polyhydroxybenzene lowers the sensitivity of a high-sensitivity emulsion, such that pressure blackening is not improved to a satisfactory level.

SUMMARY OF THE INVENTION

An object of the present invention is to provide a method of improving the pressure-resistance of optimally chemical-sensitized tabular silver halide grains without lowering the light-sensitivity thereof.

The above-mentioned object of the present invention has been attained by providing a silver halide photographic material comprising a support having thereon at least one silver halide emulsion layer comprising a silver halide emulsion containing colloidal silica, 70% or more of the total projected area of all the silver halide grains contained in the emulsion are tabular grains each having an aspect ratio of 3 or more and the mean silver iodide content of all of the silver halide grains contained in the emulsion is 0.6 mol % or less.

DETAILED DESCRIPTION OF THE INVENTION

The present invention is described in detail below.

The colloidal silica for use in the present invention has a mean grain size of generally from 5 nm to 1000 nm, preferably from 5 nm to 500 nm, and consisting essentially of silicon dioxide and optionally containing, as a minor component, alumina or sodium aluminate in an amount of preferably from 0 to 0.1 g per g of the silicon oxide. The colloidal silica may contain, as a stabilizer, an inorganic base such as sodium hydroxide, potassium hydroxide, lithium hydroxide or ammonia, or an organic base such as tetramethylammonium ion.

The colloidal silica for use in the present invention is described in, for example, JP-A-53-112732 and JP-B-57-009051 and JP-B-57-051653.

Specific examples of the colloidal silica for use in the present invention include commercial products of Snowtex 20 ($SiO_2/Na_2O \geqq 57$), Snowtex 30 ($SiO_2/Na_2O \geqq 50$), Snowtex C ($SiO_2/Na_2O \geqq 100$) and Snowtex O ($SiO_2/Na_2O \geqq 500$) from Nissan Chemical Co. (Tokyo, Japan). ($SiO_2/Na_2O$) as referred to herein means a weight ratio of the content of silicon dioxide ($SiO_2$) to that of sodium hydroxide as $Na_2O$. The above values were obtained from the catalog of the commercial products.

The addition amount of the colloidal silica to the silver halide emulsion layer for use in the present invention is preferably from 0.05 to 1.0, especially preferably from 0.1 to 0.6, as a dry weight ratio to a (water-soluble) binder such as gelatin contained in the same emulsion layer.

The total amount of water-soluble binder contained in the one or more silver halide emulsion layers containing the colloidal silica of the present invention is preferably 3.0 $g/m^2$ or less, especially preferably 2.0 $g/m^2$ or less, per each side of the support. The "total amount" is the sum of the content of the water-soluble binder of each of the silver halide emulsion layers of the present invention comprising colloidal silica and a tabular silver halide grain present per each side of the support. The water-soluble binder for use in the present invention is a hydrophilic colloidal substance such as gelatin or a natural or synthetic hydrophilic polymer.

The total amount of the colloidal silica contained in the one or more silver halide emulsion layers of the present invention is preferably less than 1.5 $g/m^2$, especially preferably from 0.1 to 0.6 $g/m^2$, per each side of the support.

For preparing the tabular silver halide grains for use in the present invention, known methods in the art may be selected and combined without any particular restriction.

For instance, tabular silver halide grains are described in, for example, Cugnac and Chateau, *Evolution of the Morphology of Silver Bromide Crystals during Physical Ripening*, published by Science et Industrie Photography, Vol. 33, (1962), pp. 121 to 125; Duffin, *Photographic Emulsion Chemistry*, by Focal Press, New York, 1966, pp. 66 to 72; A. P. H. Trivelli & W. F. Smith, *Photographic Journal*, Vol. 80, p. 285 (1940); and the tabular grains are readily prepared, by reference to JP-A-58-127921, JP-A-58-113927 and JP-A-58-113928 and U.S. Pat. No. 4,439,520.

The tabular silver halide grains for use in the present invention preferably have a projected area diameter of from 0.3 to 2.0 μm, especially preferably from 0.5 to 1.2 μm. The distance between the parallel planes (thickness) of each grain is preferably from 0.05 μm to 0.3 μm, especially preferably from 0.1 μm to 0.25 μm; and the aspect ratio of each grain is 3 or more, preferably from 3 to less than 20, especially preferably from 4 to less than 8. The tabular silver halide emulsion for use in the present invention preferably contains tabular silver halide grains each having an aspect ratio of 3 or more, more preferably from 4 to less than 8, in an amount of 70% or more (as the projected area) of all the grains contained in the emulsion.

Of tabular silver halide grains, especially useful are mono-dispersed hexagonal tabular grains.

For details of the structure of mono-dispersed hexagonal tabular grains for use in the present invention as well as a method of preparing the same, reference may be made to the specification of JP-A-63-151618.

Next, the silver halide emulsion of the present invention is described in detail below with respect to the halogen composition thereof.

Silver halide grains prior to formation of the final surface thereon are herein called base grains. Base grains for use in the present invention may have a uniform halogen composition throughout the grain, or may be two-layered or multi-layered grains having a high content iodide phase in the core of each grain or on the surface of the grain. Especially preferred for use in the present invention are two-layered grains having a high content iodide phase in the core of each grain. In the present invention, it is essential that the mean iodide content of all of the final grain of the present invention having a surface layer as finally formed thereon is 0.6 mol % or less.

More preferably, the mean iodide content of all of the grain forming the emulsion of the present invention is desirably less than 0.4 mol %. A pure silver bromide emulsion is also preferably used.

For forming a silver iodobromide layer on the surfaces of the grains constituting the emulsion of the present invention, a potassium bromide solution may be added to a base grain emulsion. Especially preferred methods for this purpose include simultaneously adding a silver nitrate solution and an iodide-containing solution; adding fine silver halide grains each having an AgI and/or an AgBrI composition; and adding a solid as prepared by dissolving potassium iodide or both potassium iodide and potassium bromide in a gelatin solution followed by cooling the resulting solution. In particular, especially preferred for the present invention are a method of simultaneously adding a silver nitrate solution and an iodide-containing solution; and a method of adding fine silver halide grains having an AgI and/or an AgBrI composition.

When fine silver halide grains having an AgI and/or an AgBrI composition are added, the grain size thereof is preferably 0.5 μm or less, preferably 0.2 μm or less, especially preferably 0.1 μm or less.

For forming a silver iodobromide layer on the surfaces of the grains constituting the emulsion of the present invention, any known silver halide solvent can be used advantageously.

Preferred silver halide solvents include thioether compounds, thiocyanates, tetra-substituted thioureas and aqueous ammonia solutions. Above all, especially effective are thioether compounds and thiocyanates. For thiocyanates, the addition amount thereof is preferably from 0.5 g to 5 g and more preferably from 2 g to 5 g, per mol of silver halide; and for thioether compounds the addition amount is preferably from 0.2 g to 3 g and more preferably from 0.5 g to 2 g, per mol of silver halide.

In order to more effectively attain the effects of the present invention, it is desirable to incorporate into the emulsion a silver halide adsorbing substance in an amount of generally 0.5 mmol or more, preferably from 0.5 to 3 mmol and more preferably from 0.7 to 2 mmol, per mol of silver halide. When used, the silver halide adsorbing substance is present during chemical sensitization of the emulsion in the course of preparing the same, as described in JP-A-2-68539. The silver halide adsorbing substance may be added at any stage of formation of silver halide grains, immediately after formation of the grains, and before or after initiation of chemical ripening of the grains. The silver halide adsorbing substance is preferably added to the emulsion before addition of chemical sensitizing agents (for example, gold and sulfur sensitizing agents), or simultaneously with the addition of the chemical sensitizing agents. The silver halide adsorbing substance (when used) is necessarily present in the emulsion system at least during the step of chemical sensitization of the emulsion.

The silver halide adsorbing substance is preferably added at a temperature of preferably from 30° to 80° C., more preferably from 50 to 80° C. in view of enhancement of the adsorbing power, and further at a pH of preferably from 5 to 10 and at a pAg of preferably from 7 to 9 upon the chemical sensitization.

The silver halide adsorbing substance as referred to herein means a sensitizing dye or a photographic property stabilizing agent and includes other types of compounds which are well adsorbed onto silver halide.

Examples of the silver halide adsorbing substances include compounds known in the art as antifoggants and stabilizers, for example, azoles, such as benzothiazolium salts, benzimidazolium salts, imidazoles, benzimidazoles, nitroindazoles, triazoles, benzotriazoles, tetrazoles, and triazines; mercapto compounds, such as mercaptothiazoles, mercaptobenzothiazoles, mercaptoimidazoles, mercaptobenzimidazoles, mercaptobenzoxazoles, mercaptothiadiazoles, mercaptoxadiazoles, mercaptotetrazoles, mercaptotriazoles, mercaptopyrimidines, and mercaptotriazines; thioketo compounds, such as oxazolinethiones; azaindenes, such as triazaindenes, tetrazaindenes (especially, 4-hydroxy-substituted (1,3,3a,7)tetrazaindenes), and pentazaindenes.

Useful silver halide adsorbing substances also include purines and nucleic acids, as well as the high polymer compounds described in JP-B-61-36213 and JP-A-59-90844.

Above all, azaindenes as well as purines and nucleic acids are preferably used in the present invention. The addition amount of these compounds is from 10 to 30 mg, preferably from 20 to 200 mg, per mol of silver halide.

Silver halide adsorbing substances for use in the present invention preferably include sensitizing dyes to thereby enhance the effects of the present invention. Useful sensitizing dyes include, for example, cyanine dyes, merocyanine dyes, complex cyanine dyes, complex merocyanine dyes, holopolar cyanine dyes, styryl dyes, hemicyanine dyes, oxonole dyes and hemioxonole dyes.

Advantageous sensitizing dyes for use in the present invention are described in, for example, U.S. Pat. Nos. 3,522,052, 3,619,197, 3,713,828, 3,615,643, 3,615,632, 3,617,293, 3,628,964, 3,703,377, 3,666,480, 3,667,960, 3,679,428, 3,672,897, 3,769,026, 3,556,800, 3,615,613, 3,615,638, 3,615,635, 3,705,809, 3,632,349, 3,677,765, 3,770,449, 3,770,440, 3,769,025, 3,745,014, 3,713,828, 3,567,458, 3,625,698, 2,526,632, 2,503,776, JP-A-48-76525, and Belgian Patent 691,807. The addition amount of the sensitizing dyes to the emulsion of the present invention is preferably from 300 mg to less than 2000 mg, more preferably from 400 mg to less than 1000 mg, per mol of silver halide.

Specific examples of sensitizing dyes which are effectively used in the present invention are given below.

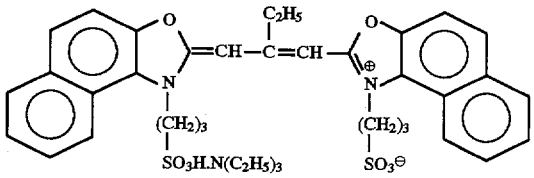

I-1

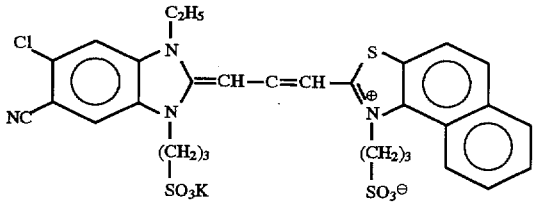

I-2

-continued

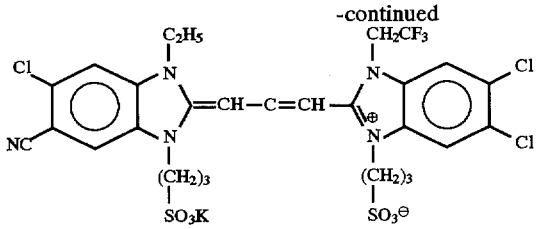

I-3

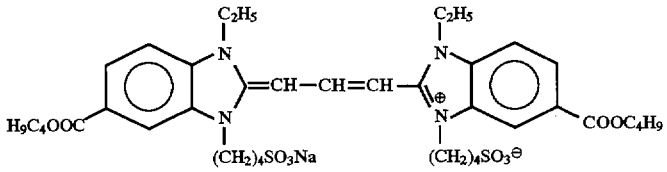

I-4

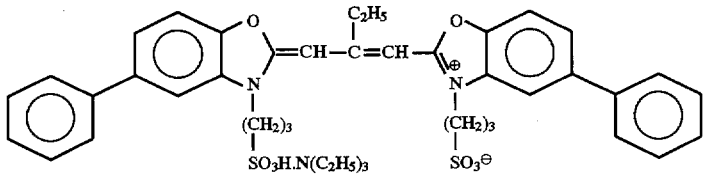

I-5

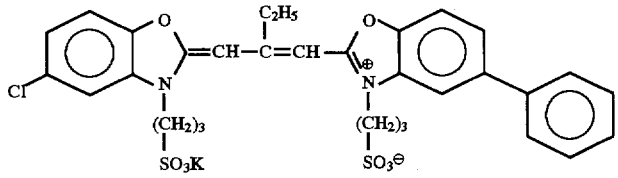

I-6

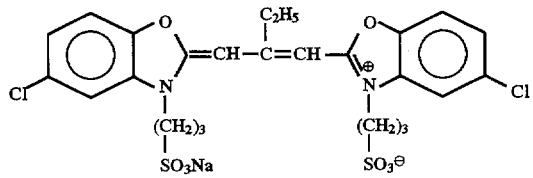

I-7

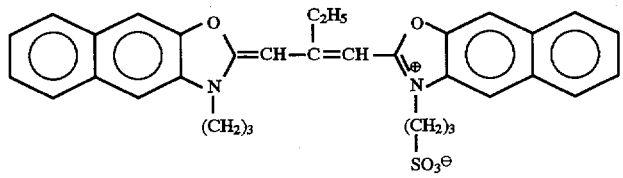

I-8

In a preferred embodiment, the above described one or more sensitizing dyes and one or more stabilizers are used in combination incorporation into the emulsion of the present invention. The sensitizing dyes for use in the present invention may be added to the emulsion after chemical sensitization of the emulsion and before coating.

For chemical sensitization of the silver halide emulsion of the present invention, any known methods of sulfur sensitization, selenium sensitization, reduction sensitization and noble metal (gold) sensitization to be conducted in the presence of the above-described one or more silver halide absorbing substances may be employed singly or in combination thereof.

A gold sensitization method is a typical noble metal sensitization, in which a gold compound, essentially a gold complex, is used. In this method, one or more complexes of a noble metal other than gold, such as platinum, palladium or iridium, may also be incorporated with no difficulty. Specific examples of the noble metal complexes are described in, for example, U.S. Pat. No. 2,448,060 and British Patent 618,061.

Sulfur sensitizing agents for use in the present invention include sulfur compounds contained in gelatin as well as other various sulfur compounds, such as thiosulfates, thioureas, thiazoles, and rhodanines. Specific examples thereof are described in, for example, U.S. Pat. Nos. 1,574,944, 2,278,947, 2,410,689, 2,728,668, 3,501,313 and 3,656,955.

The combination of sulfur sensitization with thiosulfates and gold sensitization is especially preferred, for effectively attaining the effects of the present invention.

Useful reduction sensitizing agents include stannous salts, amines, formamidinesulfinic acids and silane compounds.

The photographic emulsions for use in the present invention can contain other various compounds, apart from the above-described silver halide adsorbing substances, which are added to the emulsion during the chemical sensitizing step to prevent fogging of photographic materials during the manufacture, storage and photographic processing thereof, or to stabilize the photographic properties thereof. For example, useful for these purposes are compounds known in the art as antifoggants or stabilizers, such as azoles (e.g., benzothiazolium salts, nitroimidazoles, nitrobenzimidazoles, chlorobenzimidazoles, bromobenzimidazoles, nitroimidazoles, benzotriazoles, aminotriazoles); mercapto compounds (e.g., mercaptothiazoles, mercaptobenzothiazoles, mercaptobenzimidazoles, mercaptothiadiazoles, mercaptotetrazoles, mercaptopyrimidines, mercaptotriazines); thioketo compounds (e.g., oxazolinethiones); azaindenes (e.g., triazaindenes, tetrazaindenes (especially, 4-hydroxysubstituted (1,3,3a,7) tetrazaindenes), pentazaindenes); and benzenethiosulfonic acids, benzenesulfinic acids, and benzenesulfonic acid amides.

Especially preferred are nitron and derivatives thereof as described in JP-A-60-76743 and JP-A-60-87322; mercapto compounds as described in JP-A-60-80839; and heterocyclic compounds and complexes of heterocyclic compounds and silver (e.g., 1-phenyl-5-mercaptotetrazole silver) as described in JP-A-57-164735. Even if sensitizing dyes are used as a silver halide adsorbing substance in the chemical sensitizing step in preparation of the emulsion of the present invention, spectral sensitizing dyes for differing wavelength ranges may also be added to the emulsion.

The photographic material of the present invention can contain various surfactants, in the photographic emulsion layers or in any other hydrophilic colloid layers, for various purposes, for example, as coating aids, antistatic agents, for improvement of a sliding property, for improvement of emulsification and dispersion for prevention of surface adhesion, and for improvement of photographic properties (e.g., acceleration of development, elevation of contrast and elevation of sensitivity).

For example, useful surfactants include nonionic surfactants such as saponins (non-steroid type), alkylene oxide derivatives (e.g., polyethylene glycol, polyethylene glycol/polypropylene glycol condensate, polyethylene glycol alkyl ethers, polyethylene glycol alkylaryl ethers, silicone-polyethylene oxide adducts), and alkyl esters of saccharides; anionic surfactants such as alkylsulfonic acid salts, alkylbenzenesulfonic acid salts, alkylnaphthalenesulfonic acid salts, alkylsulfate esters, N-acyl-N-alkyltaurins, sulfosuccinic acid esters, and sulfoalkylpolyoxyethylene alkylphenyl ethers; amphoteric surfactants such as alkylbetaines, and alkylsulfobetaines; and cationic surfactants such as aliphatic or aromatic quaternary ammonium salts, pyridinium salts, and imidazolium salts.

Of them, especially preferred are anionic surfactants such as saponins, sodium dodecylbenzenesulfonate, sodium di-2-ethylhexyl α-sulfosuccinate, sodium p-octylphenoxyethoxyethanesulfonate, sodium dodecylsulfate, sodium triisopropylnaphthalenesulfonate, sodium N-methyl-oleyltaurin; cationic surfactants such as dodecyltrimethylammonium chloride, N-oleoyl-N',N',N'-trimethylammoniodiaminopropane bromide, and dodecylpyridium chloride; betaine surfactants such as N-dodecyl-N,N-dimethylcarboxybetaine, and N-oleyl-N,N-di-methylsulfobutylbetaine; and nonionic surfactants such as poly(mean polymerization degree n=10)oxyethylene cetyl ether, poly(n=25)oxyethylene p-nonylphenyl ether, and bis(1-poly(n=15)oxyethylene-oxy-2,4-di-t-pentylphenyl)ethane.

As an antistatic agent for prevention of static charges, especially preferably used in the present invention are fluorine-containing surfactants such as potassium perfluorooctanesulfonate, sodium N-propyl-N-perfluorooctanesulfonylglycine, sodium N-propyl-N-perfluorooctanesulfonylaminoethyloxy-poly(n=3) oxyethylene butanesulfonate, N-perfluorooctanesulfonyl-N',N',N'-trimethylammoniodiaminopropane chloride, and N-perfluorodecanoylaminopropyl-N', N'-dimethyl-N'-carboxybetaine; the nonionic surfactants described in JP-A-60-80848, JP-A-61-112144, JP-A-62-172343 and JP-A-62-173459; and alkali metal nitrates, electroconductive tin oxide, zinc oxide and vanadium pentoxide, and antimony-doped complex oxides thereof.

The photographic material of the present invention can contain, as a matting agent, fine grains of various organic compounds such as homopolymers of polymethyl methacrylate, copolymers of methyl methacrylate and methacrylic acid, and starch, as well as those of various inorganic compounds such as silica, titanium dioxide, sulfuric acid, strontium, and barium.

The grain size of the fine matting grains is preferably from 1.0 to 10 μm, especially preferably from 2 to 5 μm.

The surface layer of the photographic material of the present invention may contain, as a sliding agent (e.g., lubricant), one or more compounds selected from the silicone compounds described in U.S. Pat. Nos. 3,489,576 and 4,047,958, colloidal silica as described in JP-B-56-23139, as well as paraffin wax, higher fatty acid esters and starch derivatives.

The hydrophilic colloid layers of the photographic material of the present invention may contain, as a plasticizer, one or more polyols such as trimethylol-propane, pentane-diol, butane-diol, ethylene glycol and glycerin.

As a binder or protective colloid for use in the emulsion layers, interlayers and surface protecting layers constituting the photographic material of the present invention, gelatin is advantageously used, but other hydrophilic colloids may also be used without any particular limitation.

For example, useful binders include proteins such as gelatin derivatives, graft polymers of gelatin and other high molecular substances, albumin, and casein; saccharide derivatives such as cellulose derivatives of hydroxyethyl cellulose, carboxymethyl cellulose, cellulose sulfates, as well as sodium alginate, dextran and starch derivatives; and other various synthetic hydrophilic high molecular substances of homopolymers or copolymers such as polyvinyl alcohol, polyvinyl alcohol partial acetal, poly-N-vinylpyrrolidone, polyacrylic acid, polymethacrylic acid, polyacrylamide, polyvinylimidazole, and polyvinylpyrazole.

As gelatin, lime-processed gelatin is useful as well as an acid-processed gelatin and an enzyme-processed gelatin. In addition, hydrolyzates or enzyme-decomposed products of gelatin are also useful.

Of them, preferred is combination of gelatin and dextran or polyacrylamide having a mean molecular weight of 50,000 or less. In this regard, the method described in JP-A-63-68837 and JP-A-63-149641 is also effectively applicable to the present invention.

The photographic emulsions and light-insensitive hydrophilic colloids constituting the photographic material of the present invention can contain an inorganic or organic hardening agent. For example, useful hardening agents include chromium salts (e.g., chromium alum, chromium acetate); aldehydes (e.g., formaldehyde, glyoxal, glutaraldehyde); N-methylol compounds (e.g., dimethylolurea, methyloldimethylhydantoin); dioxane derivatives (e.g., 2,3-dihydroxydioxane); active vinyl compounds (e.g., 1,3,5-triacryloyl-hexahydro-s-triazine, bis(vinylsulfonyl)methyl ether, N,N'-methylenebis-[β-(vinylsulfonyl)propionamide]);

active halogen compounds (e.g., 2,4-dichloro-6-hydroxy-s-triazine); mucohalogenic acids (e.g., mucochloric acid, mucophenoxychloric acid); and isoxazoles, dialdehyde starch and 2-chloro-6-hydroxytriazinylated gelatin. The hardening agents may be used singly or in combination thereof. Above all, the active vinyl compounds described in JP-A-53-41221, JP-A-53-57257, JP-A-59-162546 and JP-A-60-80846, and the active halogen compounds described in U.S. Pat. No. 3,325,287 are preferred.

In the present invention, high molecular weight hardening agents may also be used.

Examples of high molecular weight hardening agents for use in the present invention include aldehyde group-containing polymers such as dialdehyde starch, polyacrloein, and the acrolein copolymers described in U.S. Pat. No. 3,396,029; epoxy group-containing polymers described in U.S. Pat. No. 3,623,878; dichlorotriazine group-containing polymers described in U.S. Pat. No. 3,362,827 and *Research Disclosure* No. 17333 (1978); active ester group-containing polymers described in JP-A-56-66841; and active vinyl group- or active vinyl precursor-containing polymers described in JP-A-56-142524, U.S. Pat. No. 4,161,407, JP-A-54-65033 and *Research Disclosure* No. 16725 (1978). Of them, preferred are active vinyl group- or active vinyl precursor-containing polymers. Especially preferred are polymers having active vinyl groups or active vinyl precursors bonded to the polymer base chain via a long spacer, such as those described in JP-A-56-142524.

The hydrophilic colloid layers constituting the photographic material of the present invention are preferably hardened by such a hardening agent so that the swelling rate (percentage) of the hardened layers in water is preferably 280% or less, especially preferably from 200 to 280%.

The swelling rate in water is measured by a freeze-drying method.

Briefly, a photographic material to be measured is stored under conditions of 25° C. and 60% RH for 7 days, and the swelling rate of the hydrophilic colloid layers of the thus-stored material is measured. The dry thickness (a) is obtained by observing a cut sample piece of the material with a scanning electronmicroscope. Then, the photographic material is dipped in distilled water at 21° C. for 3 minutes and is freeze-dried with liquid nitrogen. The thickness of the swollen layer (b) is obtained by observing the freeze-dried sample with a scanning electronmicroscope. The swelling rate of the sample is calculated as a value of $[\{(b)-(a)\}/(a)]\times 100$ (%).

As a support of the photographic material of the present invention, preferred is a polyethylene terephthalate film or cellulose triacetate film.

The support is preferably surface-treated, for example, by corona discharge, glow discharge or ultraviolet irradiation, for the purpose of improving the adhesion thereof to the hydrophilic colloid layer to be formed thereon. If desired, a subbing layer made of a styrene-butadiene latex or vinylidene chloride latex may also be provided on the support, and a gelatin layer may also be provided over the subbing layer.

If desired, a subbing layer containing a polyethylene swelling agent and a gelatin-containing organic solvent may also be provided on the support. Such a subbing layer may be surface-treated so as to further improve the adhesion thereof to the hydrophilic colloid layer to be provided thereon.

The photographic material of the present invention can contain a plasticizer such as a polymer or an emulsified substance in the emulsion layers, for improving the pressure characteristics of the material.

For example, disclosed are a method of using, as a plasticizer, heterocyclic compounds in British Patent 738,618; a method of using alkyl phthalates in British Patent 738,637; a method of using alkyl esters in British Patent 738,639; a method of using polyhydric alcohols in U.S. Pat. No. 2,960,404; a method of using carboxyalkyl celluloses in U.S. Pat. No. 3,121,060; a method of using paraffin and carboxylic acid salts in JP-A-49-5017; and a method of using alkyl acrylates and organic acids in JP-A-53-28086.

The constitution of the emulsion layers and other layers constituting the photographic material of the present invention is not particularly limited. If desired, various additives may be added to the photographic material as long as the effects of the present invention are not impaired. For example, usable additives include binders, surfactants, other dyes, coating aids and thickeners as described in *Research Disclosure*, Vol. 176, pages 22 to 28 (December, 1978).

Next, the present invention is explained in greater detail by reference to the following Examples, which, however, should not be construed as limiting the invention.

EXAMPLE 1

(1) Preparation of Octahedral Grains for Comparative Samples and Samples of the Present Invention 0.35 g of potassium bromide and 20.6 g of gelatin were added to one liter of water and the solution was maintained at 50° C. To this were simultaneously added, with stirring, 40 ml of an aqueous silver nitrate solution (containing 0.28 g of silver nitrate) and 40 ml of an aqueous potassium bromide solution (containing 0.21 g of potassium bromide) by the double jet method, over a period of 10 minutes. Subsequently, 200 ml of an aqueous silver nitrate solution (containing 1.42 g of silver nitrate) and 200 ml of an aqueous potassium bromide solution (containing 1.06 g of potassium bromide) were simultaneously added thereto over a period of 8 minutes. Afterwards, 26 ml of an aqueous potassium bromide solution (containing 2.7 g of potassium bromide) was added thereto. Then, an aqueous silver nitrate solution and an aqueous potassium bromide solution were again added thereto by the controlled double jet method, in which the amount of the aqueous silver nitrate solution added was one liter (containing 140 g of silver nitrate). The initial addition rate (flow rate) of the solution was 2 ml/min, as the initial flow rate was linearly accelerated so that the addition of the solution was finished within 70 minutes, and the aqueous potassium bromide was simultaneously added thereto in such manner that the controlled potential pAg in the reaction system was be 8.58.

As a result, mono-dispersed octahedral pure silver bromide grains having an average diameter of 0.62 μm were obtained.

Next, the temperature was lowered to 35° C. and soluble salts were removed by flocculation. Again, the temperature was elevated up to 40° C., and 35 g of gelatin, 2.35 g of phenoxyethanol and 0.8 g of sodium polystyrenesulfonate (as a thickener) were added. The pH value of the emulsion was adjusted to be 6.0 with sodium hydroxide. The emulsion thus-obtained had a pAg of 8.25.

With stirring, the emulsion was subjected to chemical sensitization at 60° C. Precisely, 350 mg of Sensitizing Dye I-7 as described above was first added to the emulsion, then 3.3 mg of sodium thiosulfate, 2.6 mg of chloroauric acid and 90 mg of potassium thiocyanate were added thereto. After 40 minutes, the mixture was cooled to 35° C. As a result, the emulsion designated OCT-1 of octahedral grains was obtained.

(2) Preparation of Tabular Grains for Comparative Samples and Samples of the Present Invention 9.0 g of potassium bromide, 12 g of gelatin and 2.5 ml of an aqueous 5 wt % solution of thioether $HO(CH_2)_2S(CH_2)_2S(CH_2)_2OH$ were added to one liter of water and maintained at 45° C. To the container containing the solution were added, with stirring, 37 ml of an aqueous silver nitrate solution (containing 3.43 g of silver nitrate) and 33 ml of an aqueous solution of potassium bromide (containing 3.22 g of potassium bromide) by the double jet method, over a period of 37 seconds. Subsequently, the resulting mixture in the container was heated up to 70° C., and 90 ml of an aqueous silver nitrate solution (containing 8.33 g of silver nitrate) was added thereto over a period of 22 minutes. To this was added 9 ml of an aqueous 25 wt % ammonia solution, and the emulsion was subjected to physical ripening for 15 minutes at the same temperature. Thereafter, 8.4 ml of glacial acetic acid was added thereto. Next, an aqueous silver nitrate solution (containing 129.9 g of silver nitrate) and an aqueous potassium bromide solution were added to the mixture by the controlled double jet method over a period of 35 minutes, in such manner that the pAg value of the reaction system was maintained at 8.51. As a result, mono-dispersed tabular grains having a mean projected area diameter of 1.02 μm, a mean thickness of 0.180 μm and a variation coefficient of the projected area diameter of 16.5% were formed.

Afterwards, the temperature of the emulsion was lowered to 35° C. and soluble salts were removed therefrom by flocculation. Again, the mixture was heated to 40° C., and 35 g of gelatin, 2.35 g of phenoxyethanol and 0.8 g of sodium polystyrenesulfonate (as a thickener) were added thereto, and the mixture was adjusted to a pH of 6.0 with sodium hydroxide. The emulsion thus-obtained had a pAg of 8.23.

With stirring, the emulsion was subjected to chemical sensitization at 60° C. Precisely, 350 mg of Sensitizing Dye I-7 as described above was first added to the emulsion, then 3.3 mg of sodium thiosulfate, 2.6 mg of chloroauric acid and 90 mg of potassium thiocyanate were added thereto. After 40 minutes, the emulsion was cooled to 35° C.

As a result, the emulsion designated T-1 of tabular grains was obtained.

(3) Preparation of Light-sensitive Coating Solution

The following compounds were added to each of the above-described chemical-sensitized Emulsions OCT-1 and T-1, the amount of each compound added being per mol of the silver halide in the emulsion.

| | |
|---|---|
| 2,6-Bis(hydroxyamino)-4-diehtylamino-1,3,5-triazine | 96 mg |
| Dextran (mean molecular weight 39,000) | 28.2 g |
| Sodium Polystyrenesulfonate (mean molecular weight 600,000) | 2.0 g |
| 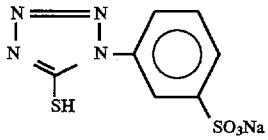 | 0.1 g |
| 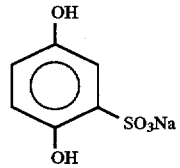 | 11.4 g |

The amount of gelatin in the coating solution was adjusted to 86.7 g per mol of silver contained therein.

From the Emulsions OCT-1 and T-1, Coating Solution Nos. (1) to (8) were prepared, each of which contained a different amount of colloidal silica having a grain size of from 10 to 20 nm. Table 1 shown below indicates the emulsions and the amount of silica contained therein as coated on one surface of a support. Coating Solution Nos. (1) to (8) correspond to coated Sample Nos. 1 to 8, respectively. As indicated below, coated Sample Nos. 7 and 8 contained colloidal silica in the surface protective layer.

TABLE 1

| Coated Sample | Emulsion | Amount of Silica in Coated Emulsion Layer | Amount of Silica in Coated Protective Layer | Relative Sensitivity | Pressure Sensitivity ΔD |
|---|---|---|---|---|---|
| Sample 1 (Comparison) | OCT-1 | — | — | 100 | 0.045 |
| Sample 2 (Comparison) | OCT-1 | 0.3 g/m² | — | 100 | 0.044 |
| Sample 3 (Comparison) | OCT-1 | 0.6 g/m² | — | 96 | 0.042 |
| Sample 4 (Comparison) | T-1 | — | — | 170 | 0.055 |
| Sample 5 (Invention) | T-1 | 0.3 g/m² | — | 170 | 0.040 |
| Sample 6 (Invention) | T-1 | 0.6 g/m² | — | 170 | 0.025 |
| Sample 7 (Comparison) | T-1 | — | 0.3 g/m² | 170 | 0.054 |
| Sample 8 (Comparison) | T-1 | — | 0.6 g/m² | 165 | 0.056 |

Last, 1,2-bis(vinylsulfonylamido)ethane was added to each coating solution as a hardening agent in an amount of 2.12 g per mol of silver contained therein.

(4) Preparation of Coating Solution for the Surface Protective Layer

A coating solution for the surface protective layer was prepared, comprising the components described below.

| Components | Amount Coated |
|---|---|
| Gelatin | 0.966 g/m$^2$ |
| Sodium Polyacrylate (mean molecular weight: 400,000) | 0.023 g/m$^2$ |
| 4-Hydroxy-6-methyl-1,3,3a,7-tetrazaindene | 0.015 g/m$^2$ |
| $C_8H_{17}$—(C6H4)—$(OCH_2CH_2)_3$—$SO_3Na$ | 0.013 g/m$^2$ |
| $C_{16}H_{33}O$—$(CH_2CH_2O)_{10}$—H | 0.045 g/m$^2$ |
| $C_{17}H_{33}CON(CH_3)CH_2CH_2SO_3Na$ | 0.0065 g/m$^2$ |
| $C_8H_{17}SO_2N(C_3H_7)$—$(CH_2CH_2O)_{15}$—H | 0.003 g/m$^2$ |
| $C_8H_{17}SO_2N(C_3H_7)$—$(CH_2CH_2O)_4$—$(CH_2)_4SO_3Na$ | 0.001 g/m$^2$ |
| Polymethyl methacrylate (mean grain size: 3.7 μm) | 0.087 g/m$^2$ |
| Proxel (as adjusted to have pH of 7.4 with NaOH) | 0.0005 g/m$^2$ |

Three coating solutions (a), (b) and (c) for the surface protective layer, each having the above-described composition, were prepared, to which colloidal silica having a grain size of from 10 to 20 nm was either added or not added in the amounts shown below.

| | | Samples |
|---|---|---|
| Coating Solution (a) | Colloidal Silica was not added. | 1 to 6 |
| Coating Solution (b) | 0.3 g/m$^2$ of colloidal silica | 7 |
| Coating Solution (c) | 0.6 g/m$^2$ of colloidal silica | 8 |

(5) Preparation of Support (i) Preparation of Dye Dispersion D-1 for the Subbing Layer The following dye was treated in a ball mill by the method described in JP-A-63-197943.

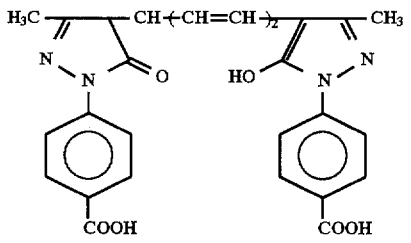

Precisely, 434 ml of water and 791 ml of an aqueous 6.7 wt % solution of surfactant Triton X-200 (TX-200) were placed in a 2-liter ball mill. 20 g of the dye was added to the solution. 400 ml of zirconium oxide (ZrO) beads (diameter: 2 mm) were added thereto, and the mixture was milled for 4 days therewith. Afterwards, 160 g of 12.5 wt % gelatin was added thereto. After defoaming, the ZrO beads were removed by filtration. The dye dispersion thus-obtained was observed to have a broad grain size (diameter) distribution of from 0.05 to 1.15 μm and a mean grain size of 0.37 μm.

By centrifugation, large dye grains having a grain size of 0.9 μm or more were removed.

As a result, dye dispersion D-1 was obtained.

(ii) Preparation of Support

A biaxially stretched 183 μm-thick polyethylene terephthalate film was surface-treated by corona discharge, and a coating solution for the first subbing layer having the composition described below was coated on the treated surface in an amount of 5.1 ml/m$^2$ with a wire bar coater. The first subbing layer was dried at 175° C. for one minute.

Next, the opposite surface of the support was also treated in the same manner, and the same first subbing layer as described above was formed thereon. The polyethylene terephthalate used for the support contained 0.04 wt % of the following dye.

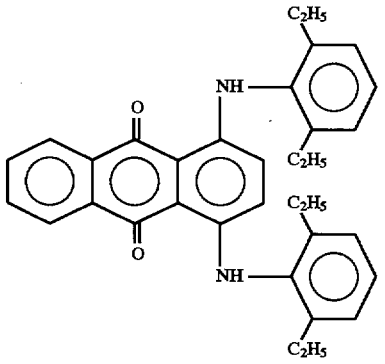

Composition of Coating Solution for the First Subbing Layer

| | |
|---|---|
| Butadiene-styrene Copolymer Latex Solution (solid content 40 wt %; butadiene/styrene = 31/69, by weight) | 79 ml |
| 21,4-Dichloro-6-hydroxy-s-triazine Sodium Salt (4 wt % solution) | 20.5 ml |
| Distilled Water | 900.5 ml |

The latex solution contained the following compound as an emulsifying and dispersing agent, in an amount of 0.4 wt % by weight to the latex solid.

$$\begin{array}{l}(n)C_6H_{13}OOCCH_2\\ \quad\quad\quad\

Replenisher of Fixer:

A mixing solution having the concentrated fixer/water ratio of 1:4

(8) Evaluation of Pressure Sensitivity

Photographic material Sample Nos. 1 to 8 were stored under conditions of 25° C. and 25% RH for one hour, and were folded at 180° around a 6 mm-diameter stainless steel pipe under the same conditions. The folding speed was one second for 180°-folding and the folded sample was immediately returned to its original state within the next one second. 30 minutes after the folding test, the samples were processed in accordance with the process described in the previous item (7).

Next, the increase of the density of the part of the sample that was stripe-like blackened along the stainless steel pipe (excluding the intrinsic fog of the emulsion and the base density) was measured with a Mackbeth densitometer.

Table 1 above shows the photographic sensitivity of each of Samples Nos. 1 to 8 and the fog density increase (ΔD) of the folded part of each of the samples. Colloidal silica inhibited the fog increase of the folded part, and the inhibiting effect due to colloidal silica was more apparent when incorporated into emulsion T-1 than into emulsion OCT-1. The inhibiting effect was obtained only when colloidal silica was added to the emulsion layer, but not to the protective layer.

EXAMPLE 2

(1) Preparation of Fine AgI Grains 0.5 g of potassium iodide and 26 g of gelatin were added to 2 liters of water and this solution was maintained at 35° C. To the solution were added 80 ml of an aqueous silver nitrate solution (containing 40 g of silver nitrate) and 80 ml of an aqueous potassium iodide solution (containing 39 g of potassium iodide), with stirring, over a period of 5 minutes. The flow rate of both the aqueous silver nitrate solution and the aqueous potassium iodide solution was 8 ml/min at the beginning of the addition, and the flow rate was linearly accelerated so that addition of all 80 ml of each of the solutions was completed within 5 minutes.

After formation of the grains in this manner, soluble salts were removed by flocculation at 35° C. Next, the emulsion was heated to 40° C., and 10.5 g of gelatin and 2.56 g of phenoxyethanol were added thereto, and the mixture was adjusted to have pH of 6.8 with sodium hydroxide. The yield of the emulsion thus-obtained was 730 g, and comprised monodispersed fine AgI grains having a mean diameter of 0.015 μm.

(2) Preparation of Tabular Grains for Comparative Samples and Samples of the Present Invention 7 g of potassium iodide, 30 g of gelatin and 2.5 ml of an aqueous 5% solution of thioether $HO(CH_2)_2S(CH_2)_2S(CH_2)_2OH$ were added to one liter of water maintained at 60° C. To the container containing the solution were added, with stirring, an aqueous silver nitrate solution (containing 8.33 g of silver nitrate) and an aqueous solution of potassium bromide (containing 6.5 g of potassium bromide) by the double jet method, over a period of 45 seconds. Subsequently, 2.5 g of potassium bromide were added thereto; and then an aqueous solution containing 8.33 g of silver nitrate was added thereto over a period of 26 minutes. The flow rate at the end of the addition was two times the flow rate at the start of the addition. Next, 13 ml of 25 wt % ammonia solution and 10 ml of 50 wt % $NH_4NO_3$ were added thereto to effect physical ripening of the emulsion for 20 minutes. Then, 160 ml of 1N sulfuric acid were added thereto to neutralize the ammonia. Subsequently, an aqueous solution of 153.34 g of silver nitrate and potassium bromide were added thereto by the controlled double jet method at a pAg controlled to 8.2, over a period of 40 minutes. The flow rate was accelerated so that the flow rate at the end of the addition was 9 times the flow rate at the start of the addition. At the end of the addition, 5 ml of 2N potassium thiocyanate solution was added thereto.

Next, different amounts of the fine AgI grains previously prepared were added to the emulsion or were not added thereto, in the manner described below, to prepare emulsions (T-2) to (T-5).

Emulsion T-2

The fine AgI grains as prepared in the previous item (1) above were added in a proportion of 0.2 mol % to the total silver amount, and then the resulting emulsion was subjected to physical ripening for 5 minutes.

Emulsion T-3

1 wt % aqueous KI solution was added in a proportion of 0.2 mol % to the total silver amount over a period of 5 minutes, and the resulting emulsion was subjected to physical ripening for 5 minutes.

Emulsion T-4

The fine AgI grains as prepared in the previous item (1) above were added in a proportion of 0.05 mol % to the total silver amount, and then the resulting emulsion was subjected to physical ripening for 5 minutes.

Emulsion T-5

No iodide was added.

Soluble salts were removed from each of Emulsions (T-2) to (T-5) by flocculation. The temperature of each of these emulsions was again elevated, and 40 g of gelatin, 2.82 g of phenoxyethanol and 0.96 g of sodium polystyrenesulfonate (as a thickener) were added to each of the emulsions. The resulting emulsions were each adjusted to have a pH of 5.90 and a pAg of 8.25 with sodium hydroxide and silver nitrate solution, respectively.

The emulsions were subjected to chemical ripening at 56° C., with stirring, in the manner described below.

Precisely, 0.056 mg of thiourea dioxide was added to the emulsion, which was then maintained in that state for 22 minutes to effect reduction sensitization. Next, 24 mg of 4-hydroxy-6-mehtyl-1,3,3a,7-tetrazaindene and 600 mg of the sensitizing dye I-7 as described above were added thereto, and 1.0 g of an aqueous calcium chloride solution was added thereto. Subsequently, 4.0 mg of sodium thiosulfate, 3.1 mg of chloroauric acid and 131 mg of potassium thiocyanate were added thereto. Then, the resulting emulsion was cooled to 35° C. after 45 minutes.

The emulsion thus-obtained contained tabular grains having an aspect ratio of 3 or more in a proportion of 95% of the total of the projected area of all the grains contained therein. The mean projected area diameter of all the grains having an aspect ratio of 2 or more was 1.4 μm; the standard deviation of the diameter was 13%; the mean thickness of the grains was 0.2 μm; and the mean aspect ratio of the grains was 7.0.

(3) Preparation of Coating Solution

The following compounds were added to each of the above-described chemical-ripened emulsions (T-2) to (T-5), the amount of each compound described below being per mol of silver halide contained in each emulsion:

| | |
|---|---|
| 2,6-Bis(hydroxyamino)-4-diethylamino-1,3,5-triazine | 96 mg |
| Trimethylolpropane | 4.0 g |
| 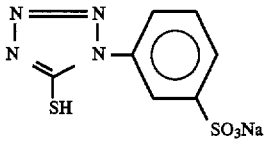 | 0.1 g |
| 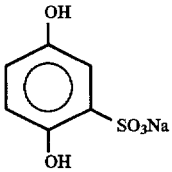 | 11.4 g |
| Dextran (mean molecular weight: 39,000) | 28.2 g |
| Sodium Polystyrenesulfonate (mean molecular weight: 600,000) | 2.0 g |

The amount of gelatin in the resulting emulsion was adjusted to 86.7 g per mol of silver contained therein.

In addition to the above-described compounds, differing amounts of colloidal silica having different grain sizes, as indicated in Table 2 below, were added to each of emulsions (T-2) to (T-5) to prepare coating solution Sample Nos. (9) to (22). Coating solution Sample Nos. (9) to (22) correspond to Sample Nos. 9 to 22 in the Table, respectively. The amount of the colloidal silica was represented by the amount as coated per each side of the support.

Lastly, 2.12 g of 1,2-bis(vinylsulfonylacetamido)ethane was added in an amount of 2.12 g per mol of silver.

(4) Preparation of Coating Solution for Surface Protective Layer

A coating solution for the surface protective layer to be coated over the emulsion layer was prepared, comprising the following components.

| Components | Amount Coated |
|---|---|
| Gelatin | 0.966 g/m$^2$ |
| Sodium Polyacrylate (mean molecular weight: 400,000) | 0.023 g/m$^2$ |
| 4-Hydroxy-6-methyl-1,3,3a,7-tetrazaindene | 0.015 g/m$^2$ |
| 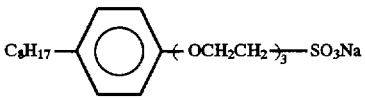 | 0.013 g/m$^2$ |
| $C_{16}H_{33}O-(CH_2CH_2O)_{10}-H$ | 0.045 g/m$^2$ |
| $C_{17}H_{33}CON(CH_3)CH_2CH_2SO_3Na$ | 0.0065 g/m$^2$ |
| $C_8H_{17}SO_2N(C_3H_7)-(CH_2CH_2O)_{15}-H$ | 0.003 g/m$^2$ |
| $C_8H_{17}SO_2N(C_3H_7)-(CH_2CH_2O)_4-(CH_2)_4SO_3Na$ | 0.001 g/m$^2$ |
| Polymethyl Methacrylate (mean grain size: 3.7 μm) | 0.087 |
| Proxel (adjusted to have pH of 7.4 with NaOH) | 0.0005 |

The support was prepared and coated with subbing layers in the same manner as in Example 1.

(5) Preparation of Coated Samples

Each of the above-described emulsion coating Solution Nos. (9) to (22) and the above-described surface protective layer coating solution were coated on both sides of the support by the single-layer co-extrusion method. The amount of silver coated was 1.8 g/m$^2$ per each side of the support. The amount of water-soluble binders of gelatin and dextran in the coated light-sensitive emulsion layer was 1.9 g/m$^2$ per each side of the support.

Thus, coated Sample Nos. 9 to 22 were obtained.

Coated Sample Nos. 9 to 22 were stored under the conditions of 25° C. and 60% RH for 7 days, whereupon the swelling rate of the hydrophilic colloid layers of each sample was measured. The dry thickness (a) was obtained by observing a cut sample piece of each of the stored samples with a scanning electronmicroscope. Then, the samples were dipped in distilled water of 21° C. for 3 minutes and were freeze-dried with a liquid nitrogen. The thickness of the swollen layer (b) of each freeze-dried sample was obtained by observing with a scanning electronmicroscope. The swelling rate of each sample was obtained as the value of $[\{(b)-(a)\}/(a)]\times 100$ (%), which was 225 to 235% for Sample Nos. 9 to 22.

(6) Evaluation of Photographic Properties

Each of Sample Nos. 9 to 22 was exposed from both surfaces thereof using a X-ray Orthoscreen HR-4 (manufactured by Fuji Photo Film Co.) for 0.05 second, whereupon the sensitivity of each sample was evaluated. After exposure, the exposed samples were processed in accordance with the same process as in Example 1. The sensitivity of each sample was represented as a reciprocal of the ratio of the exposure amount providing a density of 1.0, relative to the sensitivity of sample No. 9 taken as 100 (as a standard).

(7) Evaluation of Pressure Sensitivity

Photographic material Sample Nos. 9 to 22 were stored under conditions of 25° C. and 25% RH for one hour and were folded at 180° around a 6 mm-diameter stainless steel pipe under the same conditions. The folding speed was one second for 180°-folding, and the folded sample was immediately returned to its original state within the next one second. 30 minutes after the folding test, the samples were processed in accordance with the same process as in the previous item (6) above.

Next, the increase of the density of the part of each sample that was stripe-like blackened along the stainless steel pipe (excluding the intrinsic fog of the emulsion and the base density) was measured with a Mackbeth densitometer.

Table 2 below shows the photographic sensitivity of each of Sample Nos. 9 to 22 and the fog density increase (ΔD) of the folded part of each of the samples. Colloidal silica was found to inhibit the fog increase of the folded part. It is noted that colloidal silica having a smaller grain size exhibited a higher fog-inhibiting effect.

TABLE 2

| Sample | Emulsion | Grain Size of Colloidal Silica (nm) | Amount of Silica Coated ($g/m^2$) | Relative Sensitivity | Pressure Sensitivity ΔD |
|---|---|---|---|---|---|
| Sample 9 (Comparison) | T-2 | — | — | 100 | 0.050 |
| Sample 10 (Invention) | T-2 | 10 to 20 | 0.1 | 100 | 0.045 |
| Sample 11 (Invention) | T-2 | 10 to 20 | 0.3 | 100 | 0.040 |
| Sample 12 (Invention) | T-2 | 10 to 20 | 0.6 | 98 | 0.030 |
| Sample 13 (Invention) | T-2 | 10 to 20 | 0.9 | 90 | 0.010 |
| Sample 14 (Comparison) | T-3 | — | — | 95 | 0.050 |
| Sample 15 (Invention) | T-3 | 10 to 20 | 0.3 | 95 | 0.040 |
| Sample 16 (Comparison) | T-4 | — | — | 75 | 0.045 |
| Sample 17 (Invention) | T-4 | 10 to 20 | 0.3 | 75 | 0.035 |
| Sample 18 (Comparison) | T-5 | — | — | 65 | 0.040 |
| Sample 19 (Invention) | T-5 | 10 to 20 | 0.3 | 65 | 0.031 |
| Sample 20 (Invention) | T-2 | 45 to 55 | 0.3 | 98 | 0.040 |
| Sample 21 (Invention) | T-2 | 210 to 220 | 0.3 | 95 | 0.042 |
| Sample 22 (Invention) | T-2 | 500 to 520 | 0.3 | 90 | 0.046 |

EXAMPLE 3

(1) Preparation of Emulsions T-6, T-7, T-8

5 g of potassium bromide, 0.05 g of potassium iodide and 2.5 ml of an aqueous 5 wt % solution of thioether $HO(CH_2)_2S(CH_2)_2S(CH_2)_2OH$ were added to one liter of water maintained at 73° C. To the container containing the solution were added, with stirring, an aqueous silver nitrate solution (containing 8.33 g of silver nitrate) and an aqueous solution (containing 5.94 g of potassium bromide and 0.448 g of potassium iodide) by the double jet method, over a period of 45 seconds. Subsequently, 2.5 g of potassium bromide was added thereto, and an aqueous solution of 8.33 g of silver nitrate was then added thereto over a period of 26 minutes. The flow rate at the end of the addition was two times the flow rate at the start of the addition. To this mixture were added 20 ml of an aqueous 25 wt % ammonia solution and 10 ml of 50 wt % $NH_4NO_3$. The resulting emulsion was subjected to physical ripening for 20 minutes, and 240 ml of 1N sulfuric acid was added thereto to neutralize the ammonia. Next, an aqueous silver nitrate solution (containing 153.34 g of silver nitrate) and an aqueous potassium bromide solution were added thereto by the controlled double jet method over a period of 40 minutes, whereupon the pAg value of the reaction system was maintained at 8.2. The flow rate at the end of the addition was nine times the flow rate at the start of the addition. 15 ml of 2N potassium thiocyanate solution was added at the end of the addition of the above components. Next, potassium iodide of differing amounts was either added to or not added to the emulsion as described below, to obtain Emulsions T-6, T-7 and T-8. These emulsions differed as to the amount of potassium iodide last added thereto.

Emulsion T-6

No potassium iodide was added.

Emulsion T-7

An aqueous 1 wt % potassium iodide solution was added in an amount of 0.3 mol % to the total silver amount, over a period of 5 minutes.

Emulsion T-8

An aqueous 1 wt % potassium iodide solution was added in an amount of 0.6 mol % to the total silver amount, over a period of 5 minutes.

Next, the temperature of each of the emulsions thus prepared was lowered to 35° C., and soluble salts were removed therefrom by flocculation. The temperature was again elevated to 40° C., and 30 g of gelatin and 2 g of phenol were added. Each of the emulsions was adjusted to have a pH of 6.40 and a pAg of 8.10 with sodium hydroxide and potassium bromide, respectively.

After the temperature of each emulsion was elevated to 56° C., 600 mg of a sensitizing dye having the following structure and 150 mg of a stabilizer were added thereto. After 10 minutes, 2.4 mg of sodium thiosulfate 5-hydrate, 140 mg of potassium thiocyanate and 2.1 mg of chloroauric acid were added to each emulsion; and each of the resulting emulsions was rapidly cooled after 80 minutes for solidification. Each of the thus-obtained emulsions contained tabular grains having an aspect ratio of 3 or more in a proportion of 98% of the total projected area of all the grains contained therein. The mean projected area diameter of all the grains having an aspect ratio of 2 or more was 1.4 μm; the standard deviation of the grain diameter was 15%; the mean thickness of the grains was 0.187 μm; and the aspect ratio of the grains was 7.5.

(2) Preparation of Coating Solutions and Coated Samples

To each of Emulsions T-6, T-7 and T-8 was added colloidal silica having a grain size of from 10 nm to 20 nm, in the manner as indicated in Table 3 below. Table 3 below shows the amount of the colloidal silica added per each side of the support of each coated sample. The coating solutions were prepared in the same manner as in Example 1, except that colloidal silica was added to the emulsions as indicated below. Preparation of the coating solution for the surface protective layer as well as preparation of the support coated with subbing layers was effected in the same manner as in Example 2.

Each of the above-described coating Solutions (23) to (31) and the coating solution for surface protective layer were coated over both sides of a 175 μm-thick transparent PET support by the single-layer co-extrusion method. The amount of silver coated was 1.8 $g/m^2$ per each side of the support.

The amount of water-soluble binders of gelatin and dextran in the coated emulsion layer was 1.9 $g/m^2$ per each side of the support.

Thus, coated Sample Nos. 23 to 31 were obtained from coating Solution Nos. (23) to (31), respectively.

Coated sample Nos. 23 to 31 were stored under the conditions of 25° C. and 60% RH for 7 days, whereupon the swelling rate of the hydrophilic colloid layers of each sample was measured. The dry thickness (a) was obtained by observing a cut sample piece of each of the stored samples with a scanning electronmicroscope. Then, the samples were dipped in distilled water of 21° C. for 3 minutes, and were freeze-dried with a liquid nitrogen. The thickness of the swollen layer (b) of each freeze-dried sample was obtained by observing with a scanning electronmicroscope.

The swelling rate of each sample was obtained as the value of [{(b)−(a)}/(a)]×100 (%), which was 225 to 235% for sample No. 23.

(3) Evaluation of Photographic Properties

Each of sample Nos. 23 to 31 was exposed from both surfaces thereof using a X-ray Orthoscreen HR-4 (manufactured by Fuji Photo Film Co.) for 0.05 second, whereupon the sensitivity of each sample was evaluated. After exposure, the exposed samples were processed in accordance with the process described below. The sensitivity of each sample was represented as a reciprocal of the ratio of the exposure amount providing a density of 1.0, relative to the sensitivity of sample No. 23 taken as 100 (as a standard).

For processing the exposed samples, an automatic developing machine ("FPM9000" manufactured by Fuji Photo Film Co.) was used to carry out the SP process (dry to dry; 45 seconds) with a developer of RD-7 and a fixer of Fuji F.

Evaluation of the pressure sensitivity of each sample was carried out in the same manner as in Example 1.

Table 3 below shows the photographic sensitivity of each of sample Nos. 23 to 31 and the fog density increase (ΔD) of the folded part of each of the samples. The pressure sensitivity of Sample Nos. 23 to 25 and Nos. 26 to 28 each having an emulsion layer having an mean iodide content of 0.6 mol % or less was decreased by addition of the colloidal silica to the emulsion layer; while the pressure sensitivity of Sample Nos. 29 to 31 having a mean iodide content of 0.9 mol % in the emulsion was increased by addition of the colloidal silica to the emulsion layer.

TABLE 3

| Sample | Emulsion | Amount of Silica Coated ($g/m^2$) | Relative Sensitivity | Pressure Sensitivity ΔD |
|---|---|---|---|---|
| Sample 23 (Comparison) | T-6 | — | 100 | 0.043 |
| Sample 24 (Invention) | T-6 | 0.3 | 100 | 0.033 |
| Sample 25 (Invention) | T-6 | 0.6 | 100 | 0.024 |
| Sample 26 (Comparison) | T-7 | — | 110 | 0.060 |
| Sample 27 (Invention) | T-7 | 0.3 | 110 | 0.055 |
| Sample 28 (Invention) | T-7 | 0.6 | 105 | 0.050 |
| Sample 29 (Comparison) | T-8 | — | 120 | 0.080 |
| Sample 30 (Comparison) | T-8 | 0.3 | 102 | 0.081 |
| Sample 31 (Comparison) | T-8 | 0.6 | 110 | 0.085 |

While the invention has been described in detail and with reference to specific embodiments thereof, it will be apparent to one skilled in the art that various changes and modifications can be made therein without departing from the spirit and scope thereof.

What is claimed is:

1. An X-ray silver halide photographic material comprising a support having thereon one or more silver halide emulsion layers comprising a silver halide emulsion containing colloidal silica having a mean grain size of from 5 to 500 nm, 70% or more of the total projected area of all of the silver halide grains contained in the emulsion are tabular grains having an aspect ratio of 3 or more, and the mean silver iodide content of all of the silver halide grains contained in the emulsion is 0.4 mol % or less, wherein the one or more silver halide emulsion layers further comprise a water-soluble binder, the addition amount of colloidal silica to the one or more silver halide emulsion layers is from 0.1 to 0.6, as a dry weight ratio to the water-soluble binder contained in the same layer, and wherein the sum of the water-soluble binder content of each of the silver halide emulsion layers comprising a tabular silver halide emulsion containing colloidal silica is 3.0 $g/m^2$ or less, per each side of the support.

2. The silver halide photographic material as in claim 1, wherein the tabular grains have a projected area diameter of from 0.3 to 2.0 μm.

3. The silver halide photographic material as in claim 1, wherein the tabular grains are mono-dispersed hexagonal tabular grains.

4. The silver halide photographic material as in claim 1, wherein the tabular silver halide grains are two-layered grains having a silver iodide content in the core portion that is higher than the silver iodide content in the shell portion thereof.

5. The silver halide photographic material as in claim 1, wherein the silver halide grains constituting the silver halide emulsion are pure silver bromide grains.

6. A silver halide photographic material as in claim 1, wherein the mean silver iodide content of all of the silver halide grains contained in the emulsion is 0.2 mol % or less.

7. An X-ray silver halide photographic material comprising a support having thereon one or more silver halide emulsion layers comprising a silver halide emulsion containing colloidal silica having a mean grain size of from 5 to 500 nm, 70% or more of the total projected area of all of the silver halide grains contained in the emulsion are tabular grains having an aspect ratio of 3 or more, and the mean silver iodide content of all of the silver halide grains contained in the emulsion is less than 0.4 mol %, wherein the one or more silver halide emulsion layers further comprise a water-soluble binder, the addition amount of colloidal silica to the one or more silver halide emulsion layers is from 0.1 to 0.6, as a dry weight ratio to the water-soluble binder contained in the same layer, and the tabular grains are prepared by a method comprising adding fine silver halide grains comprising AgI to base silver halide grains, and wherein the sum of the water-soluble binder content of each of the silver halide emulsion layers comprising a tabular silver halide emulsion containing colloidal silica is 3.0 $g/m^2$ or less, per each side of the support.

* * * * *